US012203257B2

(12) United States Patent
Kučera

(10) Patent No.: US 12,203,257 B2
(45) Date of Patent: Jan. 21, 2025

(54) WATER-SAVING DEVICE FOR FLUSH TOILETS

(71) Applicant: Jaroslav Kučera, Moravská Nová Ves (CZ)

(72) Inventor: Jaroslav Kučera, Moravská Nová Ves (CZ)

( * ) Notice: Subject to any disclaimer, the term of this patent is extended or adjusted under 35 U.S.C. 154(b) by 124 days.

(21) Appl. No.: 17/831,483

(22) Filed: Jun. 3, 2022

(65) Prior Publication Data

US 2022/0389701 A1 Dec. 8, 2022

(30) Foreign Application Priority Data

Jun. 6, 2021 (CZ) ..... CZ2021-285

(51) Int. Cl.
*E03D 13/00* (2006.01)
*E03D 11/02* (2006.01)

(52) U.S. Cl.
CPC ..... *E03D 13/007* (2013.01); *E03D 11/025* (2013.01)

(58) Field of Classification Search
CPC ..... E03D 13/007; E03D 11/025
USPC ..... 4/300.3, 301, 307, 311, 312, 424, 4/144.1–144.4, 902, 255.01
See application file for complete search history.

(56) References Cited

U.S. PATENT DOCUMENTS

| | | | | |
|---|---|---|---|---|
| 5,299,328 | A * | 4/1994 | Walega | E03D 1/003 4/341 |
| 5,390,374 | A * | 2/1995 | Hubrig | E03D 13/007 4/301 |
| 2011/0004991 | A1* | 1/2011 | Tai | E03D 11/025 4/420 |
| 2015/0000023 | A1* | 1/2015 | Massey | A61F 5/453 4/301 |

FOREIGN PATENT DOCUMENTS

| | | |
|---|---|---|
| CN | 2494389 Y | 6/2002 |
| CN | 2683726 Y | 3/2005 |
| DE | 102010046698 | 3/2012 |
| FR | 2890089 | 3/2007 |

* cited by examiner

*Primary Examiner* — Tuan N Nguyen
(74) *Attorney, Agent, or Firm* — Blank Rome LLP

(57) ABSTRACT

A water-saving device that addresses the problem of saving drinking water when using flush toilets, such as in households and in public facilities. The device has a hollow profile of a guiding part, into which a hollow inner profile with a collection container is inserted. The device is not a part of the toilet but can be easily connected to it and used at any time. The device can be used on both the inside and outside of the toilet, for men, women and children.

11 Claims, 2 Drawing Sheets

WATER-SAVING DEVICE FOR FLUSH TOILETS

RELATED APPLICATION

This application claims priority to Czech patent application No. PV 2021-285 filed on Jun. 6, 2021, the subject matter of which is incorporated herein by reference in its entirety.

FIELD OF THE INVENTION

The invention relates to a device designed to save drinking water in flush toilets, such as those used in households and in public facilities.

BACKGROUND OF THE INVENTION

Flushing urine in toilets represents a significant consumption of drinking water as a valuable external resource in the household, up to 40 liters per person and day.

For some time, there have been efforts to design flush toilets so that the volume of water used per flush can be influenced or adjusted in some way. For the longest time, both in public facilities and in households, two-button flushing systems have been used with the adjustment of the amount of flushed water, where one button is used for a small flush of 3 liters of water, the second button flushes 6 liters of water.

Another cost-effective method is the use of flushometers. The flush valve is connected to the water pipe and is located above the toilet. Water flows from the valve as long as the valve is pushed. The technical installation requirements must be observed for the flushometers to function properly. Automatic flushing systems represent more complex units, which, in addition, require electric power.

Although each of these flushing methods can save a certain amount of water, there is a prerequisite that the entire device must be 100% operational. In particular, the seals on the outlet must be checked to ensure they do not leak even a small, unnoticeable amount of water, otherwise it would be impossible to talk about savings. All flushing systems require regular checking of the functionality of all their components as well as their maintenance.

Saving the volume of water consumed when flushing the toilet is often solved by various modifications of the internal toilet components, the inflow and outflow pipes, or by complex design solutions of the entire toilet. Relatively easier modifications of internal components are addressed, for example, in documents CN 2683726 and CN 2494389.

CN 2683726 discloses a flush toilet wherein the initially rigid water channel structure, generally with an "S" shaped termination, is made of a flexible material and provided with a spring. The flexible water channel at the end bends downwards when flushing to facilitate the flow. The water seal is maintained, but dirt and water may enter the sewer more smoothly with less water consumption.

CN2494389 discloses a branched pipe with a common water outlet in the water toilet cistern with separate water inlets to the pipes for flushing urine and stool. The water inlet for urine flushing is positioned higher than the water inlet for stool flushing and their lids are regulated by a rotating rod. Urine is flushed with a smaller volume of water than stool is flushed.

Document FR2890089 discloses a device for men, the purpose of which is to direct the flow of urine so that it does not contaminate the surroundings. It comprises a flexible hose bent at a 90-degree angle up to a few centimeters from the end entering the toilet bowl drain. Two tabs located at this end, articulated, regulate pressure, fluid movement and height adjustment. The hose is fitted with a molded receptacle at the other end to collect urine and an adjustable plastic holder to place the device in the toilet, which is automatically cleaned by flushing.

The device according to DE102010046698 is also intended for men who prefer to urinate standing up. It is attached by brackets to the fixing plate on the toilet seat and allows for height adjustment. It comprises a molded collection funnel connected pivotally to a drainage pipe extending through a manifold, to which an outlet hose is connected and a flushing hose connected to a flushing fluid storage tank equipped with a pump.

The last two documents refer to urinary flow diverting devices for men but do not address water saving for toilet flushing. No admission is made that any reference cited herein constitutes prior art. Applicant expressly reserves the right to challenge the accuracy and pertinence of any cited documents.

There is still no simple means available on the market that would allow urine to be drained directly into the toilet drain channel, would not require immediate flushing, would not cause odor in the surroundings and would be alternatively usable for man, woman and child.

SUMMARY OF THE INVENTION

The above shortcoming regarding inefficient management of drinking water in household and public flush toilets is addressed by a device according to the invention that is not a part of the toilet but can be easily connected to it and used at any time.

Accordingly, the present invention may provide a water-saving device for a flush toilet that comprises a guiding part formed by a hollow profile that includes one or two detachable joined pieces, into which an inner part, which is formed by at least one drain hollow profile, is inserted, wherein the drain hollow profile is fitted at one end thereof with a collection container that has an air lock.

In certain embodiments, the hollow profile of the guiding part is perforated; the hollow profile of the guiding part is, at least partly, made of a flexible material; the hollow profile of the guiding part comprising the two detachable joined pieces is removably or non-removably connected to the divider; the hollow profile of the guiding part comprises two pieces which form a main part and an end piece, wherein the main part is formed by two arms forming an angle, wherein one end of the main part is removably connected to the end piece; the inner part is formed by a single drain hollow profile at one end removably or non-removably connected to the collection container; the inner part is formed by two or more drain hollow profiles connected, arranged in series and/or side-by-side and/or in a bundle, connected to the collection container; the collection container is shaped anatomically; the drain hollow profile is provided with a V-shaped arm at least at one point along the entire length thereof, wherein the V-shaped arm, into which the fluid enters, forms a transition part, and the V-shaped arm, from which the fluid leaves, forms the overflow part, wherein the end of the overflow part is higher than the beginning of the transition part of the drain hollow profile in the direction of fluid flow; the end of the overflow part of the drain hollow section is provided with a fastening element; the drain hollow profile is a drain hose; the drain hose is provided with a shaped terminal; and/or the shaped terminal is perforated.

This summary is not intended to identify essential features of the claimed subject matter, nor is it intended for use in determining the scope of the claimed subject matter. It is to be understood that both the foregoing general description and the following detailed description are exemplary and are intended to provide an overview or framework to understand the nature and character of the disclosure.

BRIEF DESCRIPTION OF THE DRAWINGS

The accompanying drawings are incorporated in and constitute a part of this specification. It is to be understood that the drawings illustrate only some examples of the disclosure and other examples or combinations of various examples that are not specifically illustrated in the figures may still fall within the scope of this disclosure. Examples will now be described with additional detail through the use of the drawings, in which.

DETAILED DESCRIPTION

Figure 1:
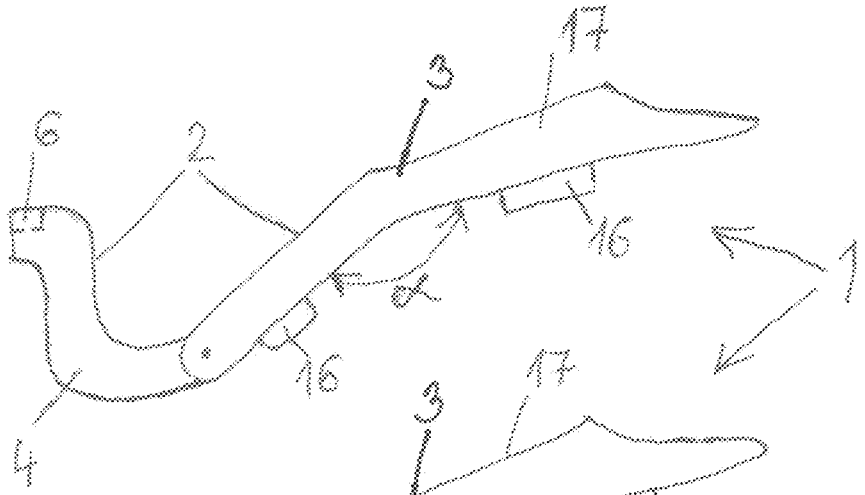
FIG. 1 shows a hollow profile of a guiding part of the device that comprises a main part and an angled terminal, according to an exemplary embodiment of the present invention.
Figure 2:
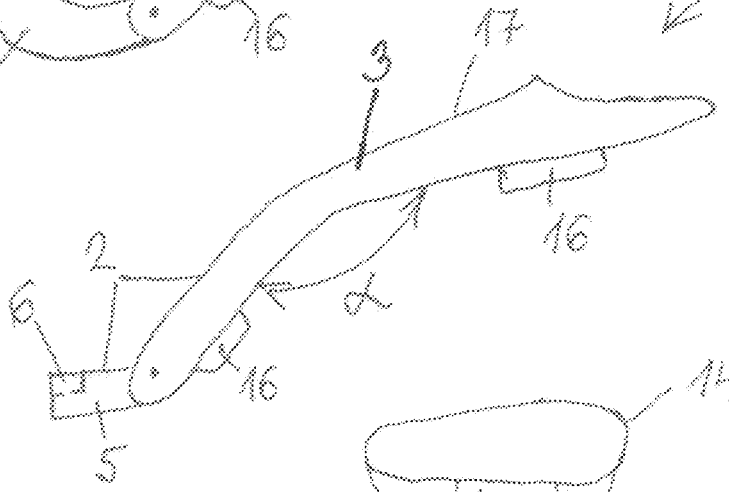
FIG. 2 shows the hollow profile of the guiding part of the device that comprises the main part and an end piece, according to an exemplary embodiment of the present invention.

The invention relates to a device comprising a guiding part formed by a hollow profile, which may be partially perforated to lighten the product and to allow excess water to drain from the system, into which is inserted an inner part formed by at least one drain hollow profile, wherein the drain hollow profile is provided with a collection container at one end.

The device according to the invention can be used by inserting it inside the toilet bowl drain but also by inserting it through an opening from the inner wall of the toilet bowl into the toilet bowl profile if it is at least partly hollow, and/or from the inner wall of the toilet bowl and routing it through the outside of the toilet to the toilet drain part.

The guiding part comprises a hollow profile of any cross-sectional shape and may be made, at least partially, of a flexible material.

If the guiding part comprises a single piece of hollow profile, it may be made, at least partially, of a flexible material capable to adapt to the shape of the toilet inner part, for example, of foamed polyethylene or plastic or plastic in "wrinkled" form, or it may be a combination of a flexible material and a non-flexible material.

According to an embodiment, the guiding part is formed by a single-piece sleeve made of any suitable material, for example rubber or plastic, of any shape, for example round, oval, square. The sleeve is fixed on the outside of the toilet bowl and the inner part of the device—the drain hollow profile fitted with a collection container—is inserted into the sleeve.

The collection container with the drain hollow profile in this embodiment can be inserted into the opening in the toilet bowl from the inside and the drain profile is routed to the outside of the toilet bowl, where it passes through the sleeve and ends in a sewer overflow or in an overflow Z-system, or it is routed to a trap, depending on the toilet design.

According to another embodiment, the guiding part is a hollow profile made of a single piece having cross-section of any shape, such as an oval or cube, made of any suitable material, for example plastic, ceramic, stainless steel, wood and other materials. The hollow profile may also consist of two detachable pieces, a guiding piece and a neck.

The hollow profile may be removably or non-removably connected to a divider that abuts the inner wall of the toilet bowl between the neck and the toilet bowl drain opening, where it abuts the inner wall of the toilet bowl and forms an impermeable barrier. The divider height can be arbitrary, depending on the amount of liquid leakage contained and its subsequent drainage through the neck of the guiding part into the waste.

The hollow profile of the guiding part is inserted into the opening in the wall of the toilet bowl from the inside, where its end or neck is fastened to the opening with a fastening element and the inner part—the drain hollow profile fitted with a collection container—is inserted into the profile of the guiding part. The profile of the guiding part can be routed inside the toilet bowl if it is hollow, or routed through an opening on the outside of the toilet bowl. The inner part with the container can be freely extended from the guiding part to the required height, according to the length of the drain profile of the inner part.

According to an embodiment, the guiding part preferably comprises two parts of hollow profile forming a main part and an end piece, wherein the main part is formed by two arms forming an angle $\alpha$, wherein the end of one arm is removably connected to the end piece, for example in the form of an S-shaped angular terminal. The angular terminal determines the direction of travel of the hose inner part and controls its travel to the waste pipe. The end piece or angular terminal may be notched. The second arm of the main part serves as a gripping part to facilitate handling the guiding part.

The angular terminal may be connected to the end of the main part of the hollow profile via swinging connection in the plane of the longitudinal section of the main part. This swinging design provides the ability to handle the container back and forth as the user needs in a given situation.

The guiding part may be made of a non-flexible material, fitted with at least one support element to support the device against the inside of the toilet. If the guiding part is not fitted with an angular terminal or end piece, then the end of the guiding part is preferably flexible, made of a flexible material. The diameter of the guiding part can be any diameter, at most such that the end of the guiding part can be placed in the drain part of the toilet bowl. All components of the guiding part have a larger diameter than the drain hollow profile of the inner part. The guiding part may have any cross-sectional shape, for example, a circle, oval, square, rectangle, rhombus, triangle, or any other shape.

The guiding part is a very important component of the whole system; its importance lies in covering the drain profile, hiding the shaped terminal, the strength and stability of the device, a firm grip and determining the handling direction. Comfortable articulation of the angular terminal with the possibility of the necessary handling behind the divider to the position of the specified angle and the easy pull-back from the toilet with comfortable bridging of the water bath is very important. The guiding part also directly determines the direction of the shaped terminal into the waste and allows the terminal to be inserted back into the guiding part. The use of a stop-condition device design for fitting the end of the guiding profile with a notch to catch the shaped terminal of the inner part in case of improper handling the product for subsequent easy release to working readiness without damaging the product is also preferable. Relief drain openings at the bottom of the guiding part of the device allow excess water to drain conveniently from the inside.

The inner part of the device comprises at least one drain hollow profile at one end, either removably or non-removably connected to the collection container. The drain hollow profile of the inner part shall be freely insertable into the hollow profile of the guiding part and shall consist of at least one piece. If it comprises multiple pieces, the individual pieces are exchangeable, interconnected or can be inserted into each other (telescopically extendable). The drain hollow profile can be made of plastic, rubber or other suitable material.

The inner part may be formed by two or more drain hollow profiles connected, arranged in series and/or side by side and/or in a bundle, connected to the collection container. The collection container is advantageously anatomically shaped and is preferably fitted with an air lock. According to an embodiment, it is also fitted with at least one gripping element and/or hanging element.

The drain hollow profile may be provided with a V-shaped bend at least at one point along the entire length thereof, wherein the V-shaped arm, into which the fluid enters, forms the transition part; this arm may be of various length and curvature and the V-shaped arm, from which the fluid leaves, forms an overflow part, wherein the end of the overflow part is higher than the beginning of the transition part of the drain profile in the direction of fluid flow. This bend on the drain hose acts as a trap, preventing the accumulation of fluid at the drain profile bottom and the penetration of odors from the toilet into the surrounding area. Preferably, the drain hollow profile is a drain hose. The drain hose bend is conveniently located immediately downstream of the air lock of the collection container. The overflow part end of the drain profile is preferably attached to the toilet.

The drain hollow profile, in particular the drain hose, may be fitted with a shaped terminal at the end entering the sewer, to which it may be removably or non-removably connected. The shaped terminal can be of any shape, for example drop-shaped, oval, square. The shaped terminal may be insertable into the end part of the guiding part hollow profile, wherein the terminal diameter is larger than the diameter of the drain hollow profile but smaller than the hollow profile of the guiding part.

The shaped terminal of any diameter may be fitted with a protrusion or shoulder, depending on the embodiment, which engages into the notch of the angular terminal or end piece of the guiding part and does not pass further through the guiding part. By this, the entire system is secured against the entire inner part sliding out of the guiding part. This embodiment is also preferable to be used for a stop condition in case of improper handling the product and subsequent easy release to working readiness without damage to the product. The shaped terminal also protects the end of the drain hollow profile, determines its direction, also by weight thereof, protects the hose against abrasion and helps the inner hose to move firmly in a certain direction in a given environment.

The shaped terminal can be exchanged for a shaped terminal fitted with openings, where it also has a cleaning function, wherein it is able to spray cleaning liquid inside the toilet and make the passage to the sewage system more efficient via the shape thereof and the possibility of grouping openings within the terminal.

The inner part is designed for stabilization and active forward and backward movement and direct fluid drainage from the device. The inner part is ended with the shaped terminal, which directly determines the fluid direction and protects the inner part, and can also function as a cleaning process in the waste line after replacing it with the terminal having openings. The combination of the guiding part and the inner part provides the device with unison and harmony and offers a strong continuity to the device as a whole. It allows for embodiments of various variants thereof, adaptation to various conditions and toilet designs.

The water-saving device for flush toilets in a household according to one embodiment comprises a guiding part comprising two parts of hollow perforated profiles of oval cross-section, made of plastic, a main part and an angular terminal. The main part comprises two arms forming an angle $\alpha$, wherein an S-shaped angular terminal is fitted to the end of one arm of the main part and is connected to the main part by a swinging connection in the plane of the longitudinal section of the main part. The angular terminal determines the direction of travel of the drain hollow profile of the inner part in the form of a hose and controls its travel to the waste pipe. The angular terminal is notched at the edge of the other end thereof. The second arm of the main part serves as a gripping element to facilitate handling. On the outer surface thereof, the main part is fitted with two support elements in the form of wedges to support the device on the inner surface of the toilet bowl. The inner part is inserted into the guiding part and comprises a single drain hollow profile in the form of a rubber drain hose at one end fitted with a plastic collection container. The collection container is anatomically shaped with a front narrower section and rear wider section and is fitted with a gripping element on the front side. In front of the connection to the drain hose, the collection container is fitted with an air lock inside. At the other end, the drain hose is fitted with a metal drop-shaped terminal, larger in diameter than the drain hose and smaller in diameter than the hollow profile of the guiding part. The shaped terminal is fitted with a protrusion that engages into the notch in the angular terminal when the inner part of the device is ejected, and the whole device slides out of the toilet bowl safely as a unit.

The water-saving device for public flush toilets according to another embodiment comprises a single piece of hollow profile of the guiding part in the form of a plastic sleeve, which is fixed on the outside of the toilet bowl. The drain hollow profile in the form of a hose with an extended plastic collection container screwed onto the hose end is inserted into the sleeve through an opening in the front of the toilet bowl. The container has lotus-shaped edges, is fitted with an air lock and is located inside the toilet bowl. Just behind the container, the hose is fitted with a V-shaped bend, located on the outside of the toilet bowl. The V-shaped arm, into which the fluid enters, forms the transition part and the V-shaped arm, from which the fluid leaves, forms the overflow part, wherein the end of the overflow part is higher than the beginning of the transition part of the drain hose in the direction of fluid flow. The overflow part end passes through the sleeve anchored to the outer wall of the toilet bowl using a fastening element in the form of a sealed screw. The hose is routed from the outside of the toilet, where it is fitted with a cover, and leads into the toilet drain, wherein it is fitted with a second V-shaped bend at the other end thereof.

The water-saving device for a public flush toilet according to another embodiment comprises two detachable joined pieces of the hollow profile of the plastic guiding part, wherein one piece forms the guiding part and the other piece forms the neck. The neck is fixed by the fastening element to the opening in the front of the inner wall of the toilet bowl, and the guiding piece is fitted to the neck. The plastic hose is inserted into the hollow profile in a length forming a drain hollow profile of the inner part, on which an anatomically shaped plastic collection container having an air lock is mounted. The hollow profile of the guiding part can also be made of a single piece. A silicone divider can be fitted to the hollow profile of the guiding part near the edge thereof; this divider abuts to the inner surface of the toilet bowl between the opening and the toilet drain. The divider can trap fluid leaking from the collection container. The collection container is fitted with a gripping element in the form of an extended edge and a hook next to the extended edge as a hanging element for hanging on trousers. The collection container with plastic hose is freely extendable from the inner part to the required height. The hollow profile of the guiding part is arranged in the inner part of the toilet bowl, which is hollow, and the guiding part profile leads into the toilet drain. The device can be used both sitting and standing.

This simple device replaces the direct flush after each pee with a negligible amount of drinking water by bridging the water bath in the toilet, and the device enters the waste pipe where the urine is directly drained without disturbing the purity of the toilet water or affecting the odor in the surroundings. This device can be used repeatedly without limitation until the contents of the toilet bowl need to be flushed with a larger volume of water. If the device is insertable into the toilet bowl and drain, it is simply pulled out of the toilet when not in use. The device can be used by a man, a woman or a child, both standing and sitting. Approximately 50 ml of residual urine remains in the drain hose, depending on the diameter of the hose or other hollow profile. The device can be rinsed with a smaller volume of water or any disinfectant immediately after use or after a certain period of time. The cost of this maintenance is negligible compared to the value of drinking water consumed for flushing without the use of this device.

Example 1

The water-saving device for household flush toilet comprises the guiding part 1 comprising one part of the hollow profile 2 of circular cross-section made of flexible polyethylene foam. The inner part 8 comprising the single drain hollow profile 9 in the form of a plastic hose, at one end provided with the plastic collecting container 14 mounted on the hose, is inserted into the guiding part 1. The collection container 14 is anatomically shaped with a front narrower section and rear wider section and is fitted with the gripping element 17 on the front side. In front of the connection to the drain hose, the collection container 14 is fitted with an air lock 22 inside.

Example 2

Figure 3:
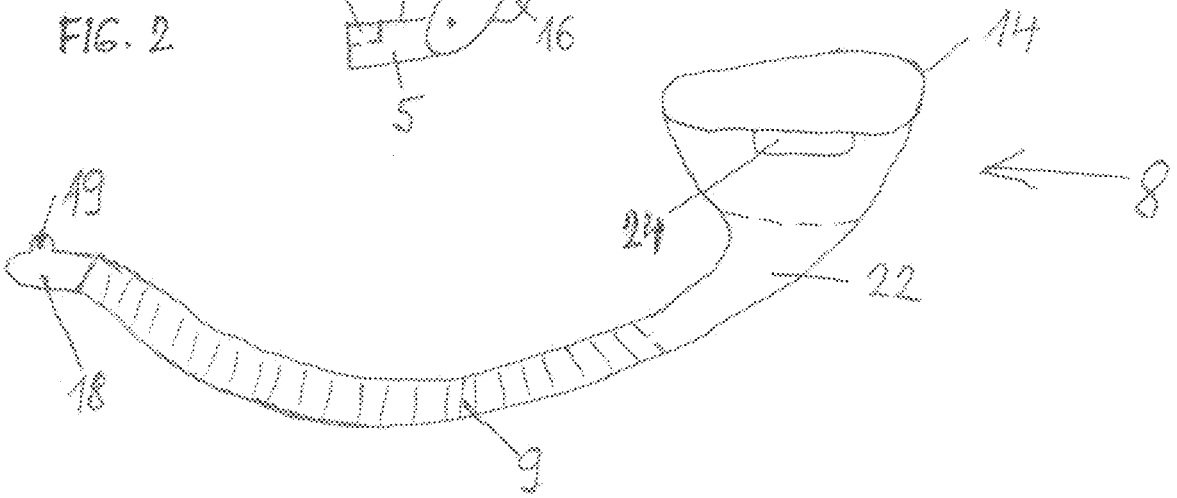
FIG. 3 shows an inner part of the device that comprises a drain hollow profile fitted with a collection container and ended with a shaped terminal, according to an exemplary embodiment of the present invention.

The water-saving device for flush toilets in a household comprises the guiding part 1 comprising two parts of hollow perforated profiles 2 of oval cross-section, made of plastic, the main part 3 and the angular terminal 4 (FIG. 1). The main part 3 comprises two arms forming an angle α, wherein the S-shaped angular terminal 4 is fitted to the end of one arm of the main part 3 and is connected to the main part 3 by a swinging connection in the plane of the longitudinal section of the main part 3. The angular terminal 4 determines the direction of travel of the drain hollow profile 9 of the inner part in the form of a hose and controls its travel to the waste pipe. The angular terminal 4 is fitted with the notch 6 at the edge of the other end thereof. The second arm of the main part 3 serves as the gripping element 17 to facilitate handling. On the outer surface thereof, the main part 3 is fitted with two support elements 16 in the form of wedges to support the device on the inner surface of the toilet bowl. The inner part 8 is inserted into the guiding part 1 and comprises the single drain hollow profile 9 in the form of a rubber drain hose at one end fitted with a plastic collection container 14. The collection container 14 is anatomically shaped with a front narrower section and rear wider section and is fitted with the gripping element 17 on the side. In front of the connection to the drain hose, the collection container 14 is fitted with the air lock 22. At the other end, the drain hose is fitted with the metal drop-shaped terminal 18, larger in diameter than the drain hose and smaller in diameter than the hollow profile 2 of the guiding part. (FIG. 3). The shaped terminal 18 is fitted with the protrusion 19 that engages into the notch 6 in the angular terminal 4 when the inner part 8 of the device is ejected, and the whole device slides out of the toilet bowl safely as a unit.

Example 3

Figure 4:
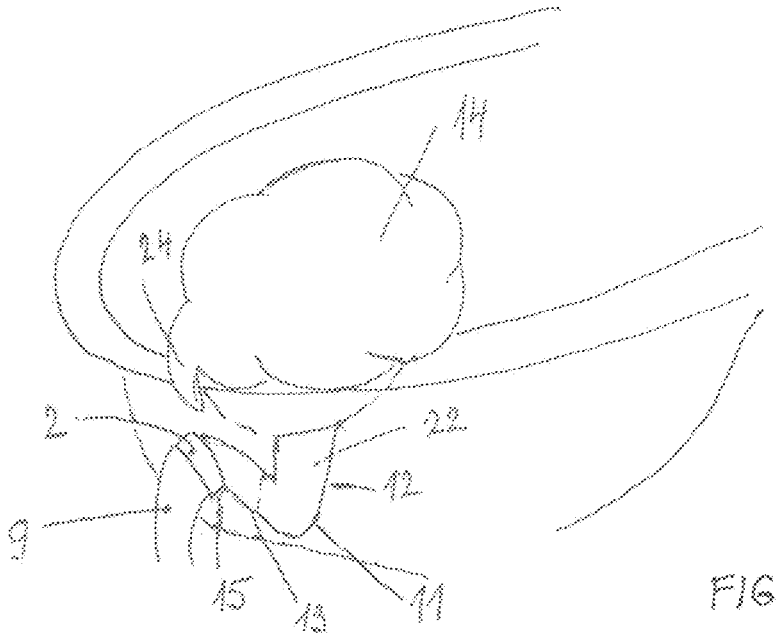
FIG. 4 shows the device inner part inserted into the opening inside the toilet bowl, and the collection container with a drain profile having a "V"-shaped bend, which passes on the outside of the toilet through the device outer part in the form of a sleeve attached to the toilet bowl, according to an exemplary embodiment of the present invention.

The water-saving device for public flush toilets comprises the single piece of hollow profile 2 of the guiding part 1 in the form of a plastic sleeve, which is fixed on the outside of the toilet bowl (FIG. 4). The drain hollow profile 9 of the inner part 8 in the form of the hose with an extended plastic collection container 14 screwed onto the hose end is inserted into the sleeve. The container 14 has lotus-shaped edges, is fitted with the air lock 22 and is located inside the toilet bowl. The hose passes through the opening in the front part of the toilet bowl and is fitted with the V-shaped bend 11 located on the outside of the toilet bowl near the container 14. The V-shaped arm, into which the fluid enters, forms the transition part 12 and the V-shaped arm, from which the fluid leaves, forms the overflow part 13, wherein the end of the overflow part 13 is higher than the beginning of the transition part 12 of the drain hose in the direction of fluid flow. The end of the overflow part 13 passes through the sleeve anchored to the outer wall of the toilet bowl using the fastening element 15 in the form of a sealed screw. The hose is routed from the outside of the toilet, where it is fitted with a cover, and leads into the toilet drain, wherein it is fitted with a second V-shaped bend 11 at the other end thereof.

Example 4

Figure 5:
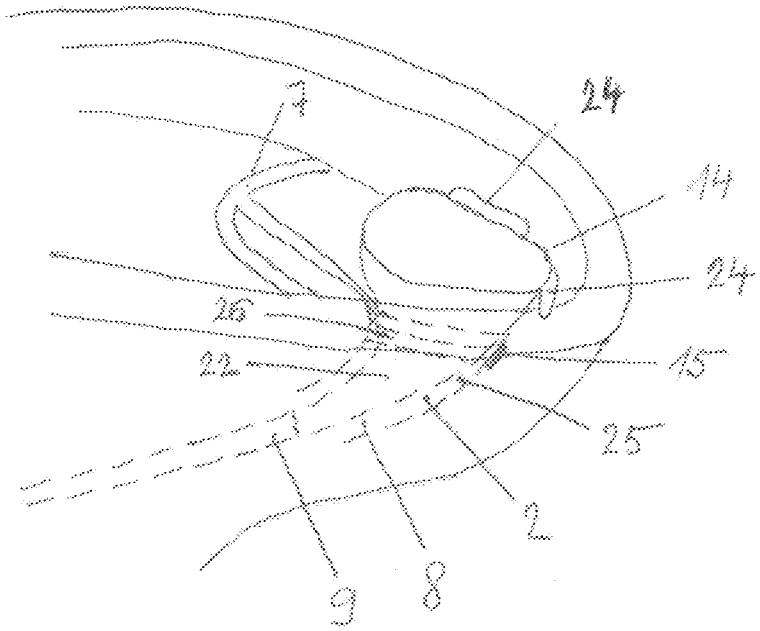
FIG. 5 shows an outer part of the device that comprises a guiding piece and a neck, inserted into an opening inside the toilet bowl, showing the collection container with a drain hollow profile is inserted into the outer part with a divider that passes through the toilet inner part, according to an exemplary embodiment of the present invention.

The water-saving device for a public flush toilet comprises two detachable joined pieces of the hollow profile 2 of the plastic guiding part, wherein one piece forms the guiding piece 25 and the other piece forms the neck 26 (FIG. 5). The neck 26 is fixed by the fastening element 15 to the opening in the front part of the inner wall of the toilet bowl, and the guiding piece 25 is fitted to the neck 26. The plastic hose in length of 0.7 m is inserted into the hollow profile 2, forming the drain hollow profile 9 of the inner part 8, on which the anatomically shaped plastic collection container 14 having the air lock 22 is mounted. On the guiding part 25 near the neck 26 or on the neck 26, the silicone divider 7 can be mounted; this divider 7 abuts to the inner surface of the toilet bowl between the opening and the toilet drain. The divider 7 can trap fluid leaking from the collection container 14.

The collection container 14 is fitted with the gripping element 17 in the form of an extended edge and a hook next to the extended edge as the hanging element 24 for hanging on trousers. The collection container 14 with plastic hose is freely extendable from the inner part 8 to the required height. The hollow profile 2 of the guiding part is arranged in the inner part of the toilet bowl, which is hollow, and the drain hollow profile 9 leads into the toilet drain. The device can be used both sitting and standing.

INDUSTRIAL APPLICABILITY

The device according to the invention helps to achieve significant savings in drinking water by significantly reducing the volume of water consumed in flush toilets both in the household and public toilets. Thanks to the variability of the design thereof, it can be used for any type of toilet. It can be easily used by men, women and children; it can be used freely, it is not a fixed part of the toilet. The costs of production, acquisition and maintenance of the device are low.

It will be apparent to those skilled in the art having the benefit of the teachings presented in the foregoing descriptions and the associated drawings that modifications, combinations, sub-combinations, and variations can be made without departing from the spirit or scope of this disclosure. Likewise, the various examples described may be used individually or in combination with other examples. Those skilled in the art will appreciate various combinations of examples not specifically described or illustrated herein that are still within the scope of this disclosure. In this respect, it is to be understood that the disclosure is not limited to the specific examples set forth and the examples of the disclosure are intended to be illustrative, not limiting.

As used in this specification and the appended claims, the singular forms "a", "an" and "the" include plural referents, unless the context clearly dictates otherwise. Similarly, the adjective "another," when used to introduce an element, is intended to mean one or more elements. The terms "comprising," "including," "having" and similar terms are intended to be inclusive such that there may be additional elements other than the listed elements.

Additionally, where a method described above or a method claim below does not explicitly require an order to be followed by its steps or an order is otherwise not required based on the description or claim language, it is not intended that any particular order be inferred. Likewise, where a method claim below does not explicitly recite a step mentioned in the description above, it should not be assumed that the step is required by the claim.

It is noted that the description and claims may use geometric or relational terms, such as right, left, above, below, upper, lower, top, bottom, linear, arcuate, elongated, parallel, perpendicular, etc. These terms are not intended to limit the disclosure and, in general, are used for convenience to facilitate the description based on the examples shown in the figures. In addition, the geometric or relational terms may not be exact. For instance, walls may not be exactly perpendicular or parallel to one another because of, for example, roughness of surfaces, tolerances allowed in manufacturing, etc., but may still be considered to be perpendicular or parallel.

REFERENCE SIGNS LIST

1— Guiding part
2— Hollow profile of the guiding part
3— Main part
4— Angular terminal
5— End piece
6— Notch
7— Divider
8— Inner part
9— Drain hollow profile of the inner part
11— Bend of the drain hose
12— Transition part of the bend
13— Overflow part of the bend
14— Collection container
15— Fastening element
16— Support element
17— Gripping element
18— Shaped terminal
19— Protrusion/shoulder of the shaped terminal
22— Air lock
24— Hanging element
25— Guiding piece
26— Neck

What is claimed is:

1. A water-saving device for a flush toilet, comprising a guiding part formed by a hollow profile including one or two detachable joined pieces, into which an inner part formed by at least one drain hollow profile is inserted, wherein the guiding part has a shape adapted to an inner part of a bowl of the flush toilet such that the guiding part is configured to be inserted into the bowl, wherein the drain hollow profile is fitted at one end thereof with a collection container having an air lock.

2. The device according to claim 1, wherein the hollow profile of the guiding part is perforated.

3. The device according to claim 1, wherein the hollow profile of the guiding part is, at least partly, made of a flexible material.

4. The device according to claim 1, wherein the hollow profile of the guiding part comprises the two detachable joined pieces removably or non-removably connected to a divider.

5. The device according to claim 1, wherein the hollow profile of the guiding part comprises two pieces which form a main part and an end piece, wherein the main part is formed by two arms forming an angle, wherein one end of the main part is removably connected to the end piece.

6. The device according to claim 1, wherein the inner part is formed by a single drain hollow profile at one end removably or non-removably connected to the collection container.

7. The device according to claim 6, wherein the collection container is shaped anatomically.

8. The device according to claim 6, wherein the drain hollow profile is a drain hose.

9. The device of the claim 8, wherein the drain hose is provided with a shaped terminal.

10. The device according to claim 9, wherein the shaped terminal is perforated.

11. The device according to claim 1, wherein the inner part is formed by two or more drain hollow profiles connected, arranged in series and/or side-by-side and/or in a bundle, connected to the collection container.

* * * * *